United States Patent [19]

Moen

[11] 4,083,554

[45] Apr. 11, 1978

[54] FLUID POWERED ARTICLE FEEDING MECHANISM

[76] Inventor: Lenard E. Moen, 7914 Michigan, Whittier, Calif. 90602

[21] Appl. No.: 739,487

[22] Filed: Oct. 26, 1976

[51] Int. Cl.[2] ..... B65H 3/44; B65H 1/02

[52] U.S. Cl. ..... 271/9; 271/149

[58] Field of Search ..... 271/9, 147, 149, 155, 271/156; 74/128

[56] References Cited

U.S. PATENT DOCUMENTS

| | | | |
|---|---|---|---|
| 1,213,626 | 1/1917 | Greene | 271/156 |
| 1,366,549 | 1/1921 | Winkley | 271/147 |
| 3,285,606 | 11/1966 | Johnson | 271/149 |

*Primary Examiner*—Richard A. Schacher
*Attorney, Agent, or Firm*—Frederick E. Mueller

[57] ABSTRACT

A power unit, comprising a telescopically joined plunger assembly and barrel assembly, is internally configured to define a pair of separate fluid chambers, each of which is alternately communicated to a common source of fluid energy. The plunger and barrel assemblies are coaxially mounted on a common support shaft along which the power unit travels in incremental steps. The external end of each of the plunger and barrel assemblies is internally fitted with a set of unidirectionally acting locking rings, each set being normally biased against an associated locking wedge and into canted positions frictionally locked onto the supporting shaft. Alternate pressurization and venting of the pair of fluid chambers alternately unlocks one set of rings and effects a limited increment of inboard movement of either the plunger assembly or barrel assembly, the other assembly remaining locked to the support shaft. The pair of wedges are keyed to the support shaft to normally support a feed paddle in driving contact with one end of a supply of articles held in a feed magazine. By means of a handle on the feed paddle, the plunger and barrel assemblies can be turned on the pair of locking wedges to mechanically unlock the two sets of rings to deactivate the device to permit its withdrawal along the shaft in the outboard direction.

48 Claims, 21 Drawing Figures

FLUID POWERED ARTICLE FEEDING MECHANISM

BACKGROUND OF THE INVENTION

Many different types of machines use mechanisms for feeding one article at a time out of a supply magazine. With specific reference to the art of manufacturing cardboard boxes of the Bliss type, the machines involved have three supply magazines for handling one stack of pre-formed body blanks and two magazines of pre-formed end panels. The presently preferred embodiment of my invention is especially adapted to use with an end panel magazine of a Bliss box making machine and, accordingly, will be disclosed and described with particular reference thereto. However, it will be appreciated that the invention has utility in the dispensing mechanisms of other types of machines.

Bliss box machines of the kind in which the automatic feed, end panel supply magazine of the present invention can be employed are disclosed in Moen et al. U.S. Pat. No. 3,342,116 and Goodrich U.S. Pat. No. 3,541,930. In the layout of both patented machines the preformed end panels are supported in their supply magazines in a horizontal row, that is, the individual end panels are in substantially vertical planes congruently superimposed or stacked in the horizontal direction along straight line in-feed axes. In the arrangement of the latter patent, a spring means is employed to bias the horizontal stack inwardly, the spring force being transmitted to the supply stack of panels by a framework slidably mounted on the magazine base framework. In the arrangement of the former patent, a chain conveyor drive system is utilized, driven through a one-way clutch mechanism powered by a single-acting fluid pressure actuator. In both patented arrangements, the driving mechanisms are relatively complex in having supporting and operating elements thereof distributed around the total framework of the end panel supply magazine.

SUMMARY OF THE INVENTION

A horizontally extending framework for the magazine includes a parallel spaced apart pair of guide members to slidably support the lower horizontal edges of the preformed end panels. The opposite sides of the magazine are defined by a parallel pair of horizontally elongate sheet metal members of angular cross-section having opposing vertically depending flanges whose lower edges are biased against the opposite vertical sides of the preformed end panels. At the inboard end of the magazine, on opposite sides thereof and in interfering alignment with the inner end of the row of panels, a pair of vertically extending stop members are fitted to the magazine with their lower edges spaced from the inboard ends of the panel support guides a distance slightly greater than the thickness of the individual end panels.

The framework of the magazine along one longitudinally extending side rigidly mounts a horizontally extending support shaft to which the feeder power unit is keyed for incremental movement in the in-feed direction. The inboard end of the power unit is fitted with a paddle contacting the outboard end of the supply of end panels and through which the force of the power unit is transmitted to the end panels to drive them inboard. The paddle is also fitted with a handle by means of which the power unit can be turned to an inoperative position to retract the power unit in an outboard direction along the support shaft to thereafter turn the paddle back against the outboard end of a new supply of end panels.

The power unit comprises a plunger assembly telescopically joined within a barrel assembly, both assemblies being coaxially joined to the support shaft. Internally of the power unit the barrel assembly and plunger assembly define a separate pair of variable volume fluid power chambers connected to a common source of pressure fluid via a control valve such that one of the chambers is in open communication with a pressure fluid while the other chamber is relieved. An end of each of the plunger and barrel assemblies is fitted with a set of unidirectionally acting locking rings in association with a locking wedge, the pair of locking wedges being keyed to the support shaft. Pressurization of one of the fluid chambers with concurrent venting of the other of the chambers effects unlocking of one of the sets of locking rings and an increment of movement of the plunger or barrel assembly in which that set of rings is mounted. Upon reversal of the pressurization and venting of the pair of chambers, the other of the assemblies is unlocked and moved for a given increment in like fashion.

DESCRIPTION OF THE PREFERRED EMBODIMENT

Figure 1:
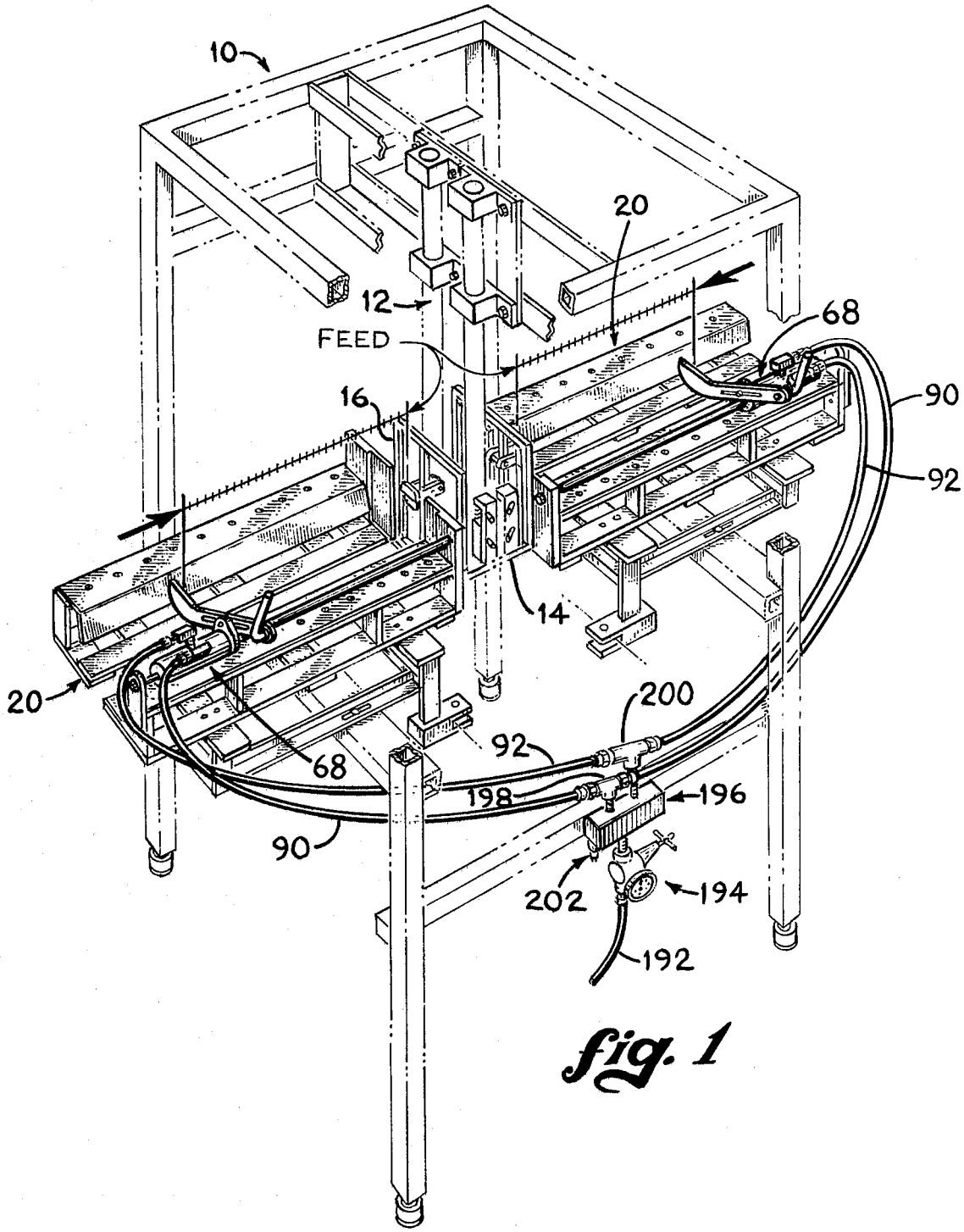
FIG. 1 is a pictorial view of a pair of automatic feeding supply magazines of the present invention and also shows, in phantom outline, portions of a Bliss box making machine.

Referring to FIG. 1, a portion of a Bliss box making machine is shown in phantom outline. The machine includes a main frame 10 that centrally mounts a parallel pair of vertically extending power cylinders 12 to vertically reciprocate a mandrel 14 inwardly and outwardly of a box forming die of the machine. The mandrel 14 is fitted on an opposite pair of sides with mandrel blockers 16 adapted for Bliss box making. Specifically, the blockers 16 are adapted to pick off or strip a preformed Bliss box end panel P out of the pair of end panel supply magazines designated generally by the numeral 20.

Bliss box machines are well known in the trade and accordingly need not be described in detail. For present purposes suffice it to say that upon a downstroke of the mandrel 14 a pair of end panels P are stripped out of the magazines 20 to be transported onto a Bliss body blank whose side walls are then erected around and adhesively secured to the pair of end panels P. For this purpose, each of the mandrel blockers 16 is fitted with a pick-off pawl mechanism 22, fitted with a torsion spring to be normally disposed in vertically interfering and pick-off alignment with the innermost end panel P of a magazine 20. On the retraction stroke of the mandrel, the pawl rotates against the torsion spring to slide past the next innermost end panel. Each of the magazines 20 is equipped with a feed mechanism to automatically advance the rows or stacks of end panels P inwardly, one step at a time, so that there is always an innermost end panel P in indexed position to be picked off upon the next downstroke of the mandrel 16.

Figure 2:
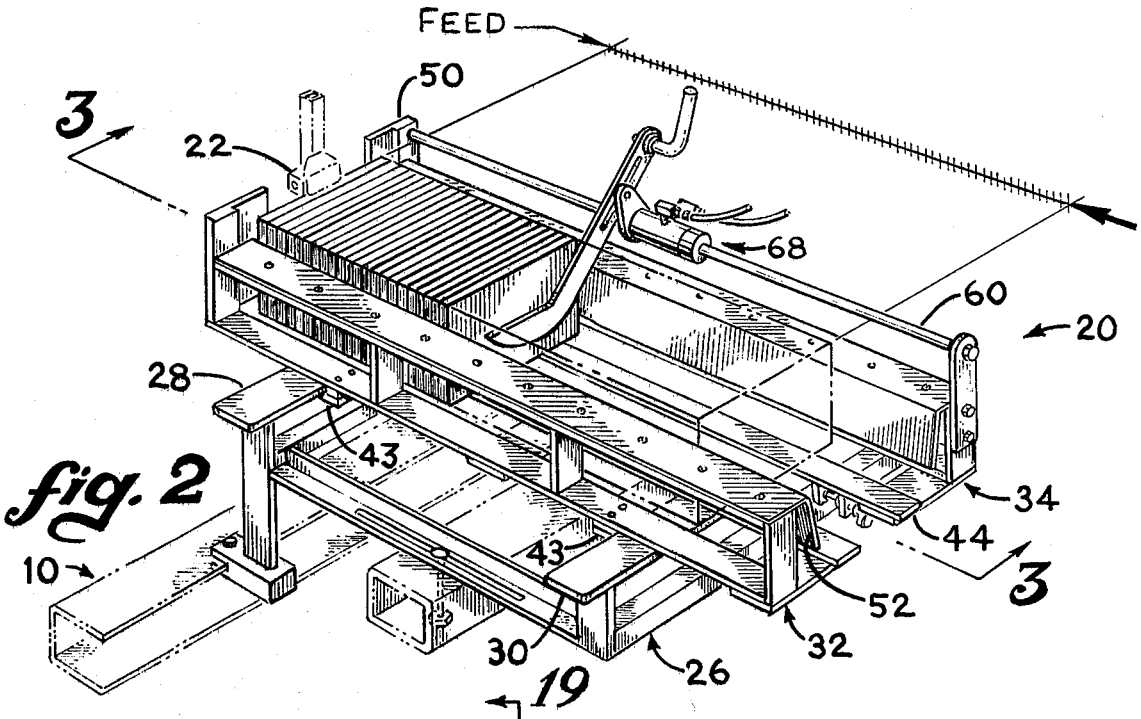
FIG. 2 is a perspective view of one of the supply magazines of FIG. 1.

Referring to FIG. 2, each magazine 20 includes a horizontal base frame 26 preferably adapted for detachable connection to the machine frame 10. The frame 26 includes an inboard transverse support strap 28 and an outboard transverse support strap 30. This pair of straps supports a parallel pair of magazine side wall assemblies 32 and 34. The side wall assemblies are mirror images of one another.

Each side wall assembly includes a horizontal longitudinally extending framing strap 38 having a spaced series of framing posts 40 secured to the upper face thereof. The upper ends of the posts 40 rigidly support an upper framing strap 42 in parallelism to the strap 38. In order to permit adjustment of the gap between a confronting pair of the side wall structures 32 and 34 to accomodate different dimensions of end panels, the side wall assemblies are preferably laterally slidably mounted on the support framework 26. For this purpose, each of the framing straps 38 may be fitted with gibs 43 slidably embracing the transverse inboard and outboard framing elements 28 and 30. A left and right hand screw mechanism (not shown) may be employed to effect the desired spacing between the side wall structures.

Figure 3:
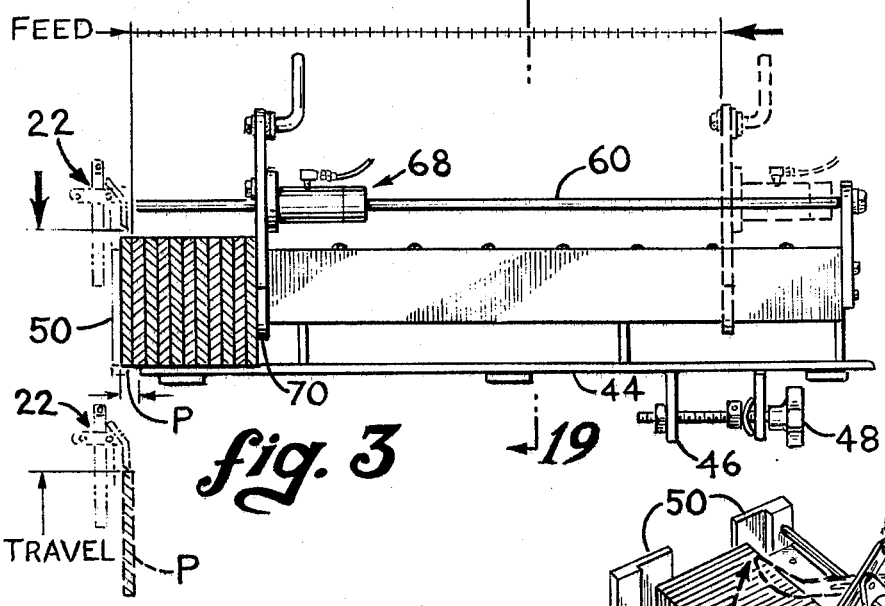
FIG. 3 is a longitudinal sectional view taken on the line 3—3 of FIG. 2.

In order to support the horizontal lower edges of the end panels P for horizontal sliding movement, each of the side wall assemblies mounts a longitudinally extending guide strap 44. Preferably, the strap 44 is mounted on the side wall assembly frame for limited longitudinal adjustment in order to serve as a guage to accomodate different thicknesses of end panels P, as by means of fasteners extending through slotted openings in the framework. As is shown in FIG. 3, the strap 44 may be fitted on its underside with a nut-bearing bracket 46 for connection to a frame supported screw adjustment means 48 by means of which the guage strap can be adjusted longitudinally.

Each of the side wall assemblies 32 and 34 has a vertically extending stop member 50 rigidly secured to the inboard end thereof serving as an abutment to index the innermost one of the end panels P in a position to be picked off by a pawl mechanism 22 of the descending mandrel. As is indicated in FIG. 3, the outboard facing side of each stop member 50 is spaced from the inboard end of the corresponding guage strap 44 a distance slightly in excess of the thickness of the end panel P, the adjustment being made by means of the mechanism 48.

Figure 19:
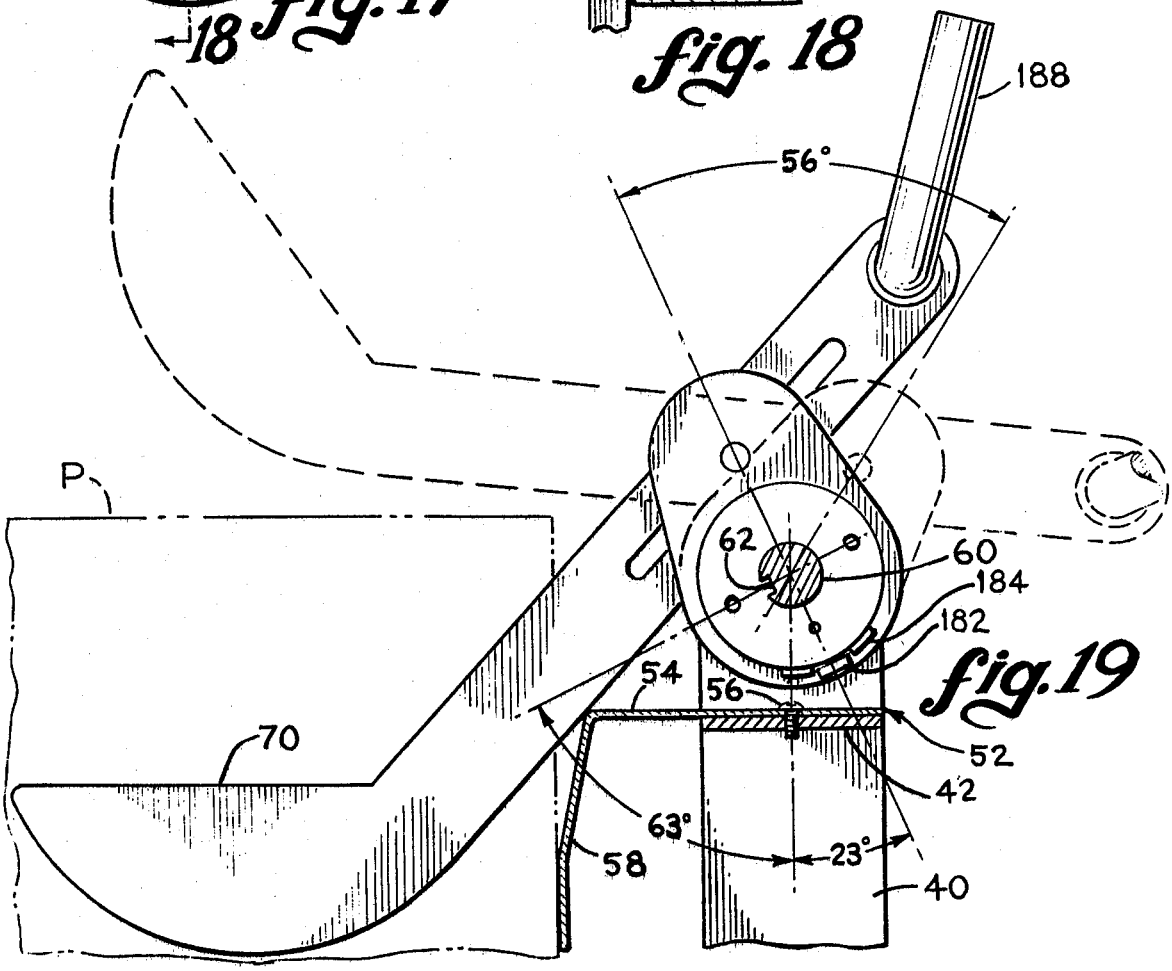
FIG. 19 is a schematic elevational view looking at one end of the power unit, the de-energized position of the power unit being shown in phantom outline.

Preferably, each of the pair of sidewalls to laterally confine the row of panels P in the magazine takes the form of an elongate horizontally extending sheet metal member 52 of angular cross-sectional configuration. A horizontal flange 54 of the sheet metal member is secured on top of the horizontally extending top framing strap 42 of the sidewall frame, as by means of a spaced series of screw fasteners 56, such that an inwardly and downwardly depending flange 58 of the side wall member engages vertically extending edges of panels supported on the pair of straps 44. Preferably, the sheet metal member 52 is of quarter hard stainless steel to be sufficiently resilient to exert an inward biasing force on vertical edges of the end panels, as is indicated in FIG. 19.

Each magazine 20 has a longitudinally extending feed mechanism mounted along one side only of the magazine. The feed mechanism includes a horizontally extending hardened solid support shaft 60 fo circular cross-section formed with a longitudinally extending keyway 62 and rigidly held in superimposed relationship to one of the side wall assemblies by means of screw fasteners 64. The shaft 60 guides and supports a power unit 68 mounted in telescoped relationship to the shaft. A feed paddle 70 is secured to the inboard end of the power unit 68, rides on the adjacent corner of member 52, and is adapted to bear against the outermost one of a row of end panels P as shown in FIGS. 2 and 3. For each cycle of operation of the power unit 68, the power unit and paddle are advanced in an inboard direction, in a ratchet-like fashion, a distance corresponding to the thickness of an end panel P, such increments of successive movement being schematically in FIGS. 2 and 3.

Figure 20:
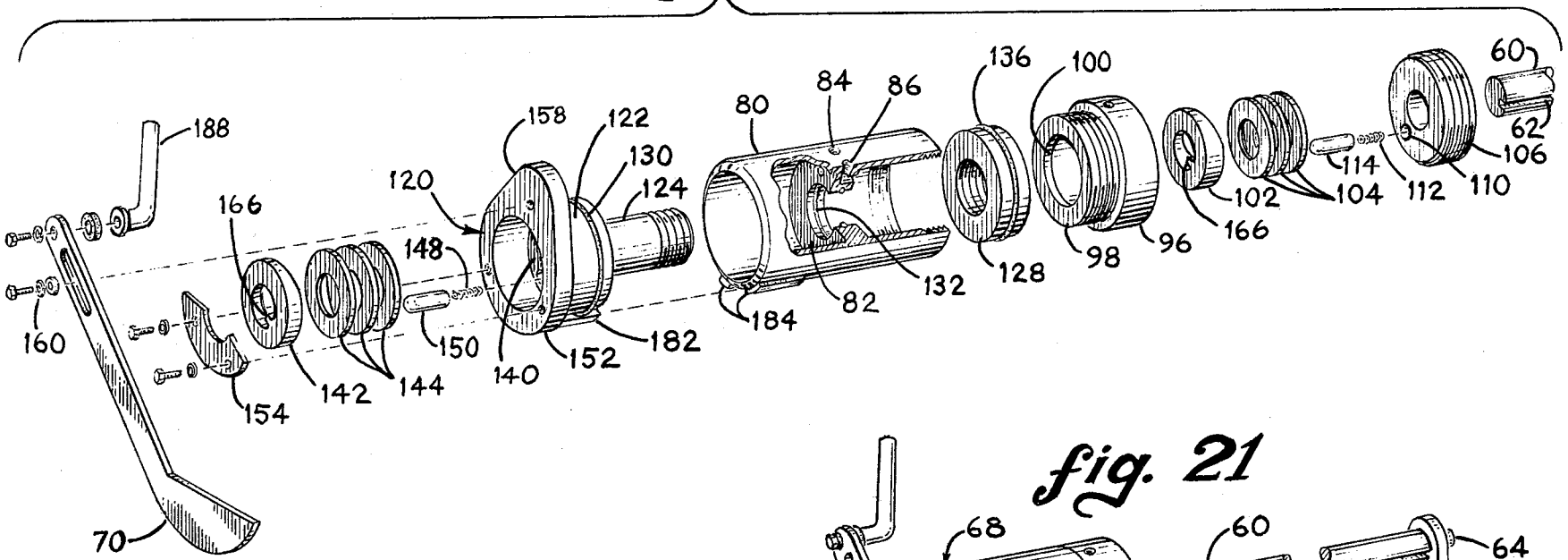
FIG. 20 is en exploded perspective view of the components of the power unit, a portion of a component being cut away to reveal internal details of configuration.
Figure 21:
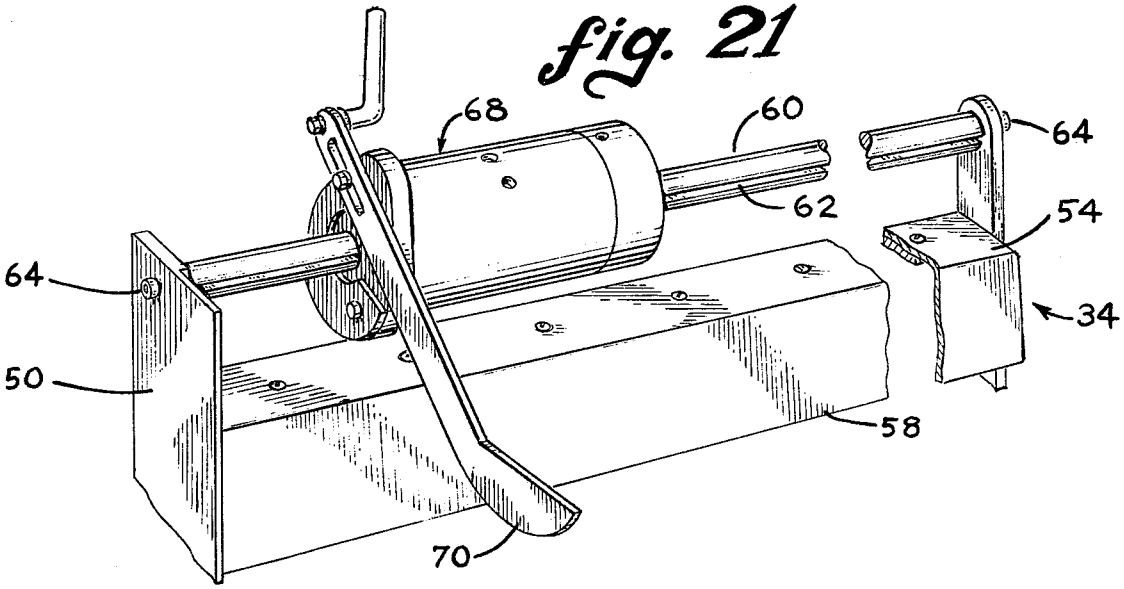
FIG. 21 is a perspective view of the power unit and its supporting framework.

The power unit 68 comprises a generally tubular barrel assembly 74 and generally tubular plunger assembly 76, which are telescopically slidably joined together and both of which are telescopically slidably mounted on the support shaft 60. The physical appearance of the components of both of these sub-assemblies is best seen in FIG. 20 and their operative relationships are schematically illustrated in FIGS. 5 through 9, in which certain plungers, keyways, and ports have been rotated from the positions of FIG. 20 to more clearly illustrate the mode of operation of the mechanism.

Figure 5:
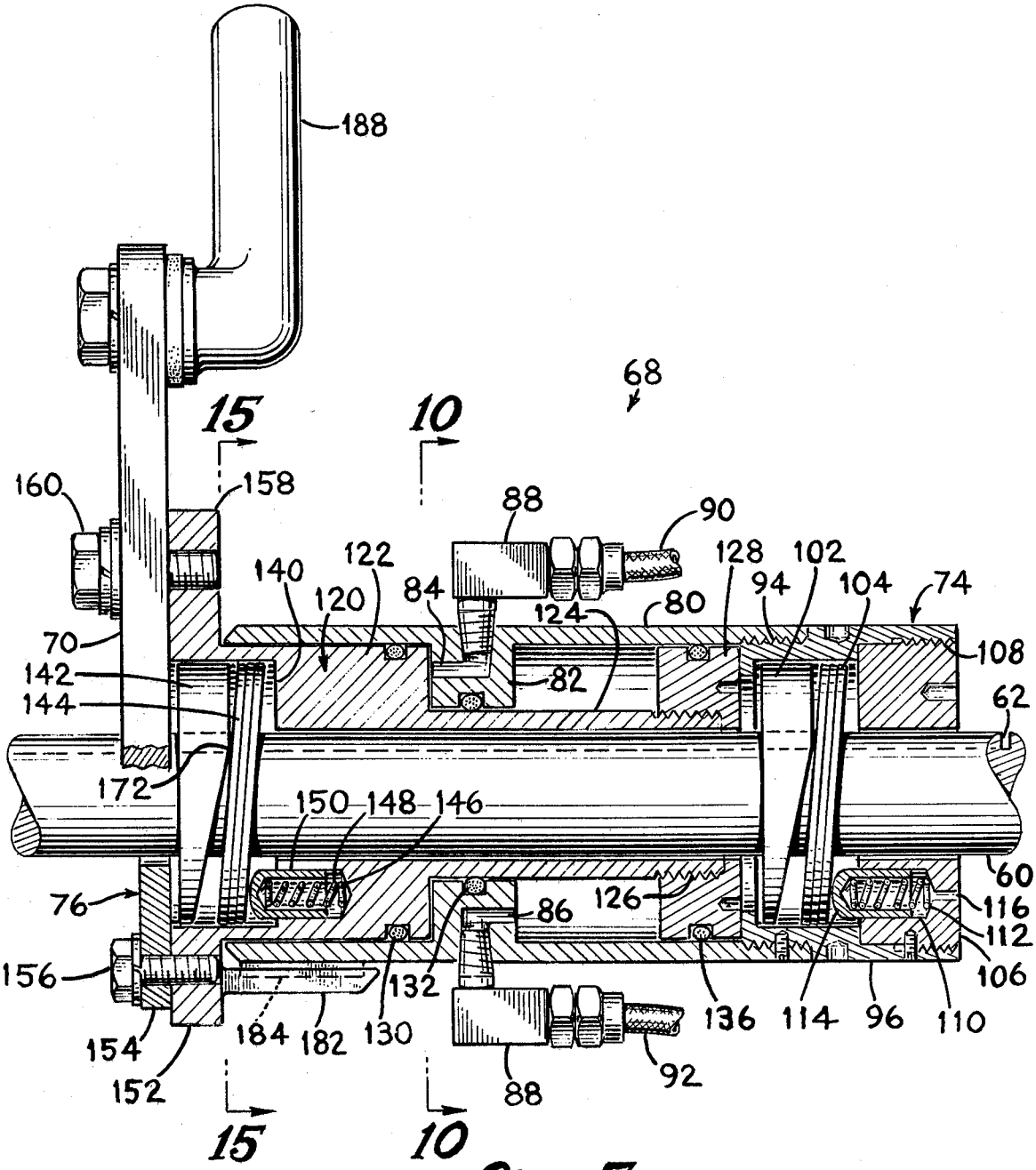
FIG. 5 is a longitudinal sectional view, on a larger scale, schematically illustrating the internal structure of the power unit.

More specifically, the barrel assembly 74 includes a generally cylindrical relatively thin-walled barrel 80 which is internally formed or fitted with a radially inwardly directed annular piston flange portion 82 of substantial radial dimension as compared to the wall thickness of the barrel. The piston flange 82 is located at about the mid-line of the barrel 80 and at circularly spaced apart areas is formed with an L-shaped pair of fluid ports 84 and 86. As is best seen in FIG. 5, the port 84 terminates at its radially inner end along an axis pointing in the inboard direction while the inner terminal axis of the other port 86 points in the opposite direction or outboard of the power unit 68. At radially outer ends, the ports 84 and 86 are tapped to receive conventional fluid couplings 88 that are coupled to fluid hoses 90 and 92.

At its outboard end, the barrel 80 is internally threaded for connection, as at 94, to the external threads of a ring cage member 96. The member 96 is somewhat cup-shaped, being formed at its inboard end with an annular floor portion 98 whose inner edge is defined by a hole 100 slidably engaged with the surface of the shaft 60. On the outboard side of the annular floor 100 and within the annular cavity defined between the internal cylindrical surface of the member 96 and the surface of the shaft 60 is an annular locking wedge 102, on the outboard side of which there is a set, e.g., three in number, of locking rings 104. The locking wedge 102 and lock rings 104 are slidably mounted on shaft 60 and are retained in the barrel assembly by an annular shoulder or retainer nut 106 threadedly secured within the outboard end of the cage member 96, as indicated at 108, and slidably mounted on the shaft 60.

On the annular inboard face of the retainer nut 106 it is formed with an axially extending pocket 110 mounting a spring 112 within a tubular plunger 114 slidably mounted in the pocket 110 and thus yieldably biased against one side of the set of lock rings 104. On its external face the retainer nut 106 is formed with a plunger locater hole 116 coaxially aligned with the plunger 114 to give an external indication of the plunger location.

The plunger assembly 76, like the barrel assembly 74, is generally tubular in construction. A plunger, designated generally by the numeral 120, has an annular body portion 122 of an external diameter to be slidably seated within the wall portion of the barrel 80 at the inboard end of the barrel. A tubular piston rod portion 124 of the plunger 120 extends coaxially in the outboard direction from the body portion 122, the plunger 120 being formed with an internal diameter adapted for coaxially slidably embracing the support shaft 60. At its outboard end the piston rod portion 124 is externally threaded for engagement, as at 126, to internal threads of an annular piston 128 whose periphery slidably engages the surface of a wall portion of the barrel member 80, at the outboard end of the barrel. The outer diameter of the tubular piston rod portion 124 slidably engages the internal diameter of the annular piston flange 82 of the barrel 80.

Figure 7:
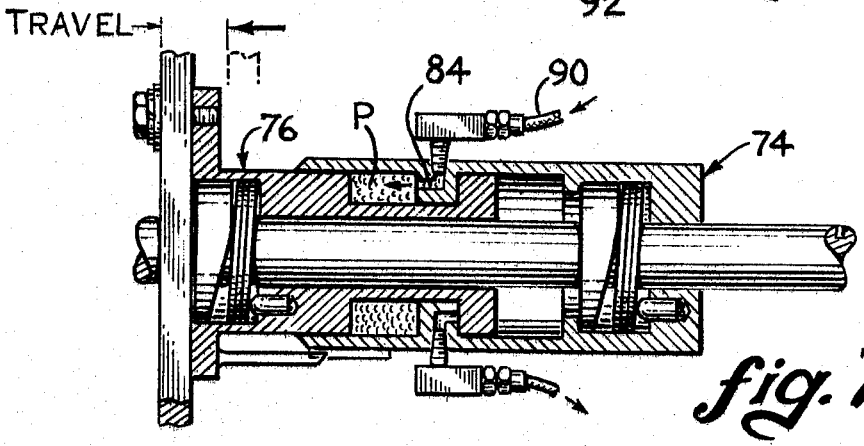
Figure 8:
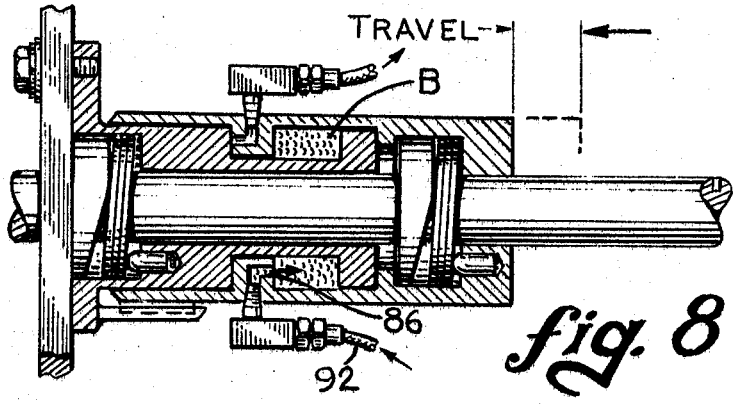

From an examination of FIG. 20 it will be seen that the plunger 122 and barrel 80 are assembled by sliding the tubular piston rod portion 124 through the central opening of the piston flange 82 of the barrel and, thereafter, screwing the annular piston 128 onto the outboard end of the piston rod portion, as indicated at 126. Thereafter, the two parts are interconnected for limited telescopic reciprocation through a stroke range positively delimited, at one end, by contact of the inboard face of the piston 128 with the outboard face of the piston flange 82 and, at the other end, by mutual contact of the inboard face of the piston flange 82 with an outboard face of an annular flange of the plunger 120, defined by the shoulder between the body portion 122 and tubular piston rod portion 124. With this arrangement, two fluid pressure chambers B and P are internally defined within the power unit 68, as is schematically indicated in FIGS. 8 and 7 respectively. In order to seal the fluid chambers B and P externally and to isolate them from one another, appropriate annular fluid seals are provided such as an O-ring 130 on the plunger body portion 122, an O-ring 132 seated within the central opening of the annular piston portion 82, and another O-ring 136 mounted in the periphery of the annular piston 128. The port 84 communicates with the chamber P while the port 86 communicates with the chamber B.

At its inboard end, the plunger 120 is cup-shaped with an annular flange or shoulder 140 to house an annular locking wedge 142 and set of lock rings 144, both slidably mounted on the shaft 60. The inboard facing shoulder 140 is formed with an axially directed spring pocket 146 receiving a spring 148 in a tubular plunger 150 slidably mounted in the pocket 146 such that the plunger is biased against the lock rings 144 against the outboard face of the locking wedge 142. To confine the locking wedge 142 and rings 144 within the plunger, a radially projecting flange 152 of plunger 120 is fitted with a crescent shaped plate 154, held in place by fasteners 156, the inner edge of the plate extending across the end opening of the plunger and across the inboard face of the locking wedge 142. The flange 152 includes a radially projecting lobe 158 to which the feed paddle 70 is secured, as by means of a fastener 160. The feed paddle 70 is securely, though adjustably, mounted so that one longitudinal edge also projects across the end opening of the plunger 120 and over the inboard face of the locking wedge 142.

Although differently numbered for convenience of reference in connection with the mode of operation of the power unit 68, the locking wedges 102 and 142 are identical, as are the locking rings 104 and 144.

Figure 13:
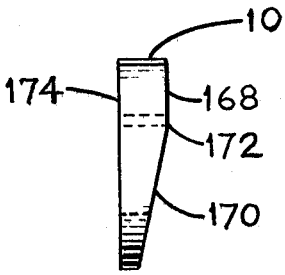
FIG. 13 is a side elevational view of a locking wedge of the power unit.
Figure 14:
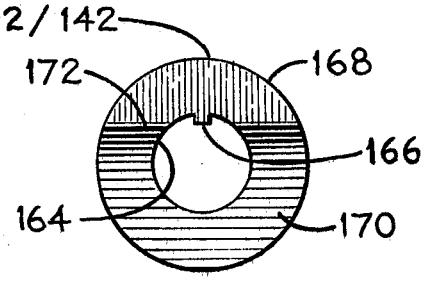
FIG. 14 is an elevational plan view of the locking wedge of FIG. 13.

Referring to FIGS. 13 and 14, the identical locking wedges 102, 142 are formed with a central hole 164 of a radius to be mounted on the support shaft 60 in a close sliding fit. Along one side of the hole 164 it is formed with a radially inwardly projecting key 166 for slidable engagement with the keyway 62 of the support shaft. The outboard face of the locking wedges is defined by a surface 168, having a radial dimension less than the radius of the outer diameter of the locking wedge and disposed in a radial plane, and another oblique plane surface 170 in a radial and inboard direction. These two plane surfaces merge in a straight line 172, of a plane which includes the radially inner end of the key 166, and defines a fulcrum for rocking action of the lock rings 104, 144. An outboard face 174 comprises a plane surface at right angles to the axis of the locking wedges 102, 142.

Figure 15:
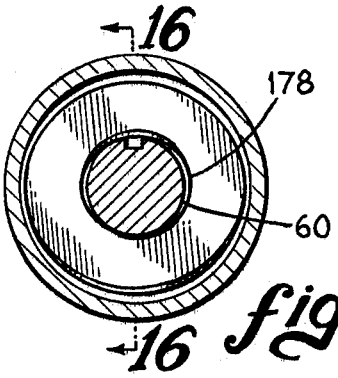
FIG. 15 is a sectional view, taken on the line 15—15 of FIG. 5, particularly showing the locking rings in locking engagement with their support shaft.
Figure 16:
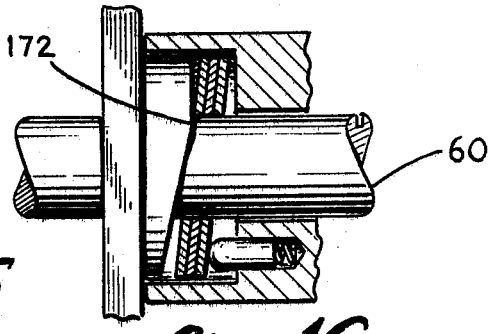
FIG. 16 is a partial longitudinal sectional view on the line 16—16 of FIG. 15.
Figure 17:
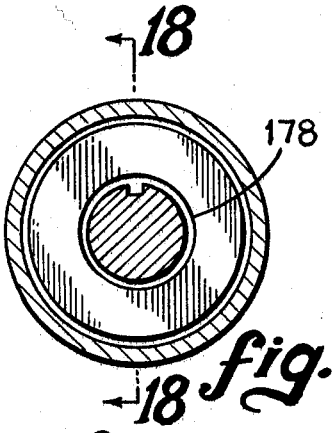
FIG. 17 is a view similar to FIG. 15 but showing the locking rings in the unlocked condition.
Figure 18:
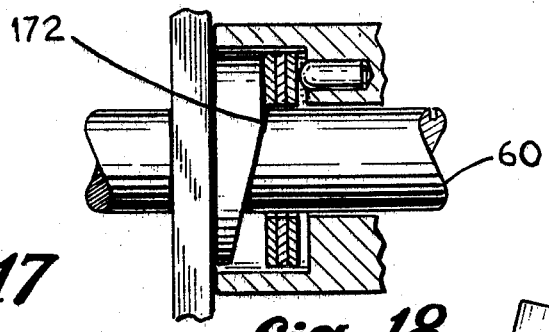
FIG. 18 is a partial longitudinal sectional view on the line 18—18 of FIG. 17.

As is shown in FIGS. 15 through 18, the locking rings 104, 144 are formed with a central circular opening 178 of slightly larger radius than that of the support shaft 60. A set of the lock rings are on the outboard side of the companion locking wedge and the ring's internal clearance with respect to the surface of the shaft 60 is such that when the rings are coaxially aligned with the shaft 60, as in FIG. 18, they are freely axially movable in the inboard direction. When canted, as in FIG. 16, the lock rings are locked against movement along the support shaft in an outboard direction since each lock ring has a pair of diametrically opposite points on opposite surfaces of the ring wedged against axially offset and diametrically opposite points on the surface of the shaft 60, as indicated in FIGS. 15 and 16.

Referring to FIG. 5, it will be seen that the pair of spring biased plungers 114, 150 are coaxially aligned with the locator hole 116 on a common axis that is normally diametrically opposite to the keyway 62 of the support shaft 60. As a result, the lock rings 104, 144 are normally biased about the fulcrum lines 172 of the locking wedges 102, 142 to lock the barrel assembly 74 and plunger assembly 76, respectively, against outboard movement along the support shaft 60.

Figure 4:
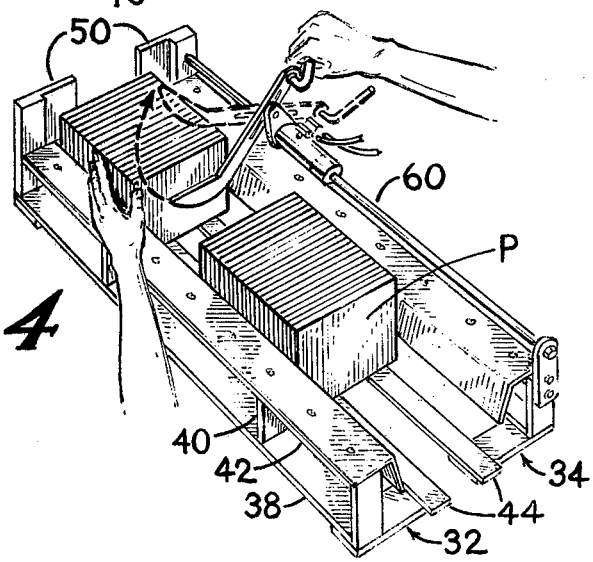
FIG. 4 is a perspective view, similar to FIG. 2, illustrating the manner of de-energizing the power unit of the feed mechanism in the operation of reloading the supply magazine.
Figure 9:
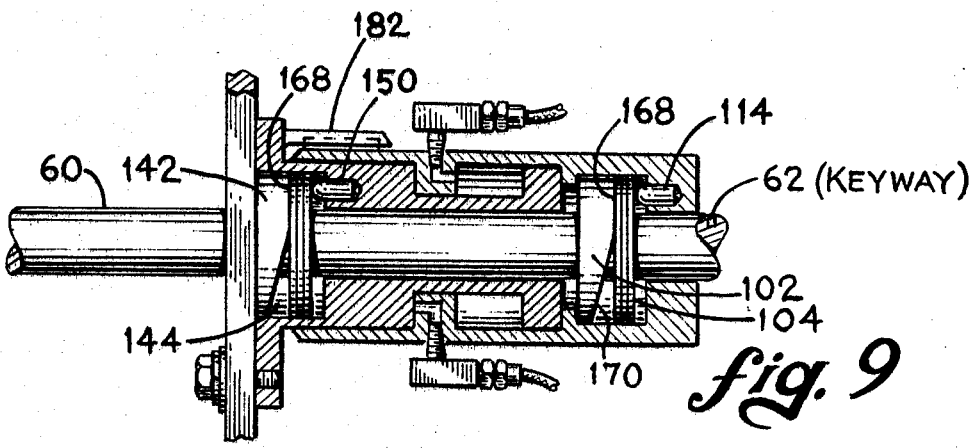
FIG. 9 is a schematic view, similar to FIG. 5, showing the relationship of the internal parts of the power unit during a de-activated phase.
Figure 10:
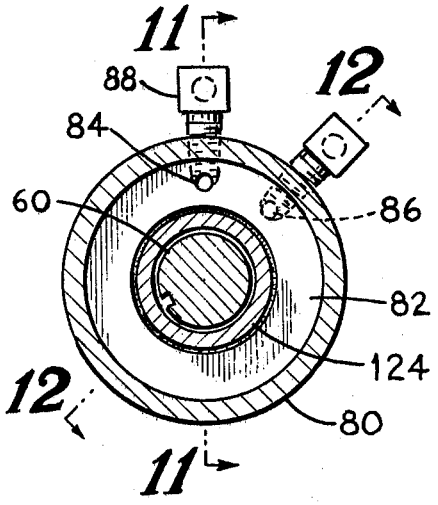
FIG. 10 is a sectional view of the power unit taken on the line 10—10 of FIG. 5.
Figure 11:
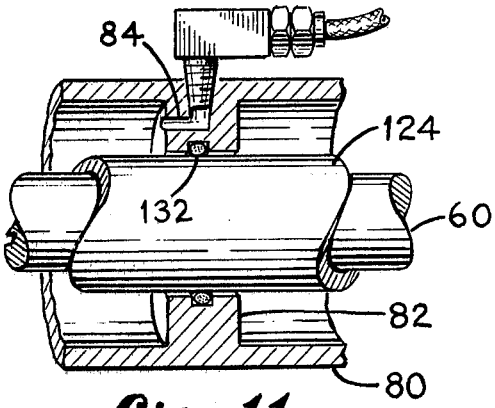
FIG. 11 is a partial sectional view taken on the line 11—11 of FIG. 10.
Figure 12:
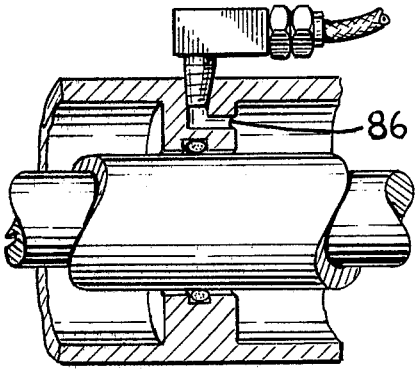
FIG. 12 is a partial longitudinal sectional view taken on the line 12—12 of FIG. 10.

The barrel assembly 74 and plunger assembly 76 are keyed together in a manner to permit relative axial reciprocation without relative angular movement. The keying means may take the form of a bar-like key member 182 secured to and projecting axially in the outboard direction from the outboard face of the plunger flange 152 and slidably received between a pair of gibs 184 externally secured to the inboard end of the barrel member 80. A handle 188 is secured to that end of the paddle member 70 outside the magazine 20. Accordingly, when the handle 188 is turned to the phantom outline position depicted in FIG. 19, the locking wedges 102, 142 remain angularly keyed to the support shaft 60 and the lock rings are initially held while other components of the barrel assembly 74 and plunger assembly 76 are rotated on shaft 60. As is shown in FIG. 9, the pair of plungers 114, 150 are thus brought into opposition to the surfaces 168 of the locking wedges whereby the two sets of locking rings 104, 144 are biased onto that surface of the locking wedges and correspondingly released from locking engagement with the support shaft 60. The power unit 68 is thus rendered inactive and can be freely retracted along the support shaft in an outboard direction to permit a fresh supply of end panels P to be placed within the magazine, as is depicted in FIG. 4, and without stopping production.

A pair of magazines 20 may have their power units 68 connected to a common source of fluid energy in the manner shown in FIG. 1. Pneumatic energy is preferred in the context of feed magazines for a box making machine. Thus, a hose 192 leads from a source of compressed air to an air pressure regulator 194 that is coupled to an electrically controlled adjustable flow control and relief valve 196. One port of the valve is fitted with a Tee 198 whose opposite ends are coupled to the hoses 90, whose other ends have fluid communication with the fluid chambers P of the pair of power units 68. In similar fashion, another port of the valve is fitted with a Tee 200 whose opposite ends are coupled to ends of hoses 92 whose other ends have fluid communication with the fluid chambers B of the pair of power units 68. The valve 196 is also fitted with an adjustable relief port 202.

The operation of the valve 196 is such that when one of the Tees 198, 200 is in fluid communication with the pressure hose 192 the other Tee is in fluid communication with the relief port 202. Accordingly, when one of the fluid chambers B/P of a power unit is in communication with the source of fluid pressure, the other chamber is vented to atmosphere with a flow rate as dictated by the adjustment of the relief port 202. The exhaust rate of flow is adjusted to eliminate slamming of the barrel assembly 74 and plunger assembly 76 upon one another. The pressure regulator 194 may of course be adjusted as desired to provide the desired pressure on the rows of end panels P in the magazines 20.

Figure 6:
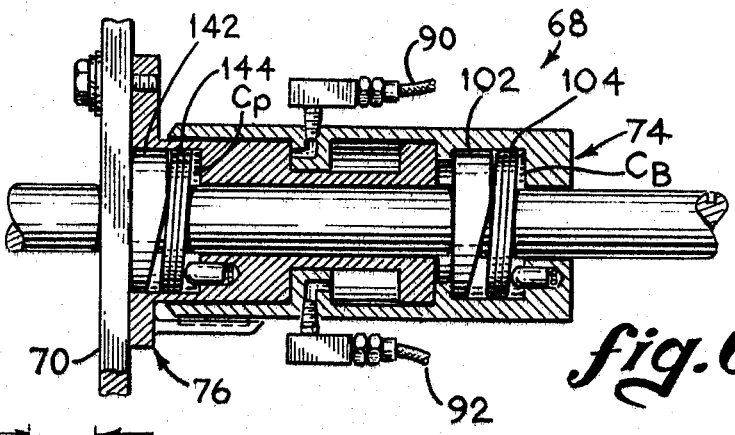
FIGS. 6, 7, and 8 are schematic views, similar to FIG. 5, showing the changing relationship of the internal parts of the power unit in a cycle of operation.

The sequence of relative movements of the parts of the power unit 68 in a cycle or operation is schematically illustrated in FIGS. 6, 7, and 8. While a row of the end panels P within a magazine 20 are not shown in these figures it is to be understood that the broad inner end of the feed paddle 70 centrally contacts the outboard one of a row or stack of end panels P pressed against the stops 50 of the magazine. This condition is shown in FIG. 3, from which it will be understood that the outboard reactive stress of the compressed row of panels P is transmitted through the paddle 70 but the power unit 68 is locked against outboard movement by the lock rings 144, 104, as illustrated in FIG. 6.

In FIG. 6, both sets of lock rings are normally biased into the loccking position by their associated plungers 150, 114, and there is a clearance C, at positions diametrically opposite to the two plungers, between the sets of locking rings 144, 104 and the inboard facing sides of their retainers. When the hose 90 is in communication with the source of fluid energy while the hose 92 is vented to atmosphere, fluid pressure is transmitted to the chamber P while the chamber B is vented. The fluid chamber P accordingly expands, driving the plunger assembly 76 in an inboard direction through the clearance $C_P$ contacting the set of lock rings 144 at one side and against the surface 168 of the locking wedge 142 and simultaneously overcoming the spring force in the plunger 150. The lock rings 144 being now coaxially aligned with the shaft 60, the entire plunger assembly advances in the inboard direction for an increment of travel as indicated in FIG. 7, thus driving the entire row of end panels P in the inboard direction until the innermost end panel abuts the pair of stops 50. Throughout this phase, the lock rings 104 of the barrel assembly 74 remain locked to the shaft 60 by virtue of the spring biased plunger 114, whereby the plunger assembly 76 reacts relative to the barrel assembly 74.

In FIG. 7 the plunger assembly 76 is depicted as having undergone a maximum increment of travel such that the inboard face of the annular piston 128 abuts the outboard face of the annular piston portion 82. The impact of any such contact is cushioned by proper adjustment of the relief port 202 of the valve 96. However, in actual practice the plunger assembly 76 and, therefore, the feed paddle 70, is less than the full increment of travel depicted in FIG. 7, to a degree depending upon the set of the air pressure regulator 194. Stated otherwise, the maximum travel stroke depicted in FIG. 7 is preferably greater than the thickness of the end panels being handled so that upon the stacked row of panels being arrested by the stops 50 the valve 196 is actuated to reverse the chambers B and P prior to the inboard face of the annular piston 128 coming into contact with the outboard face of the annular piston portion 82.

Upon venting of the chamber P to atmosphere, the reaction forces and the plunger 150 bias the lock rings 144 into locked positions as shown in FIG. 7. The plunger assembly 76 is accordingly locked against any movement in the outboard direction. The chamber B, now being pressurized, accordingly expands with a corresponding diminution in the volume of the chamber P, while the barrel assembly 74 advances through the clearance gap $C_B$ to move the set of locking rings 104 into unlocked position against the surface 168 of the locking wedge 102, after which the barrel assembly 74 is free to advance through the maximum increment of travel depicted in FIG. 8. However, normally another cycle of operation will be initiated prior to the inboard face of the annular piston portion 82 coming into contact with the outboard face of the plunger body 122.

FIG. 9 schematically illustrates the relationship of the parts in an inactivated condition of the power unit 68. The barrel assembly 74 is shown rotated 180° relative to its position as schematically indicated in FIGS. 6 through 8. During such rotation the oblique faces 170 of the locking wedges 102, 142 effect a camming action of the two sets of locking rings out of the canted locked position. The rotation of the barrel assembly is thus translated into unlocked common coaxial alignment of the shaft 60 and the two sets of locking rings, irrespective of continuing flow through the valve 196.

While the invention has herein been shown and described in what is presently conceived to be its most practical and preferred embodiment, it is to be recognized that departures may be made therefrom within the scope of the invention, which is not to be limited to the details disclosed herein but is to be accorded the full scope of the claims so as to embrace equivalent devices.

I claim:

1. An article feed apparatus comprising:

a magazine having guide means to constrain a stacked row of articles for movement along an inboard-outboard axis of said magazine;

stop means at an inboard end of said magazine against which a row of articles in said magazine can be pressed in an inboard direction to be indexed for individual delivery from said inboard end of said magazine;

an elongate rigid support on said magazine oriented along the inboard-outboard axis of said magazine;

and a power unit on said support having means to drivingly contact an outboard end of a row of articles in said magazine, said power unit having a pair of fluid chambers comprising fluid powered means to sequentially advance said power unit along said support in the inboard direction in separate increments of movement to incrementally drive the row of articles toward and against said stop means, said power unit and support having cooperating means defining a unidirectional locking means to prevent retrograde outboard movement of said power unit.

2. Apparatus as in claim 1 which said guide means of said magazine includes an elongate pair of opposed side walls adapted for slidable biasing engagement with opposite edges of articles in said magazine.

3. An apparatus as in claim 1 in which said support comprises a shaft and said power unit is of a generally tubular construction and is telescopically mounted on said shaft.

4. An apparatus as in claim 3 in which said shaft and said power unit have cooperating means to translate relative angular movement therebetween into release of said unidirectional locking means to permit withdrawal of said power unit along said shaft in an outboard direction, irrespective of continued actuation of said fluid powered means.

5. Apparatus as in claim 3 in which said power unit comprises a pair of elements coaxially interconnected for reciprocation relative to one another within a positively delimited stroke range.

6. Apparatus as in claim 5 in which said stroke range is at least equivalent to the thickness of the articles to be fed by said apparatus.

7. Apparatus as in claim 5 in which said pair of fluid chambers is defined by said pair of elements of said power unit.

8. Apparatus as in claim 5 in which said cooperating means defining said unidirectional locking means comprises a unidirectionally acting lock mechanism on each of said pair of elements, said pair of locking mechanisms being arranged to unlock independently of one another.

9. Apparatus as in claim 5 in which said pair of elements comprises a barrel assembly and a plunger assembly telescopically coaxially slidably mounted on said shaft.

10. Apparatus as in claim 9 in which said barrel assembly and said plunger assembly each internally mounts a portion of said unidirectional locking means and in which said shaft and said unidirectional locking means have cooperating key means to normally prevent angular movement of a portion of said power unit relative to said shaft.

11. Apparatus as in claim 10 in which said barrel assembly and said plunger assembly are keyed together against relative angular movement.

12. A synchronously coupled multiple feed magazine apparatus comprising:

a plurality of magazines each having an elongate rigid support oriented along the feed axis of said magazine, each of said supports mounting a power unit to drivingly contact an outboard end of a row of articles in the corresponding one of said magazines, each of said power units comprising a pair of telescopically related elements interconnected to one another and having shape characteristics to define a separate pair of inboard and outboard fluid chambers of mutually interdependent variable volume within said power unit, control means for alternately communicating either said inboard or outboard fluid chambers to a common source of fluid energy, while the others of said fluid chambers are relieved, to drive one or the other of said pair of elements in the inboard direction in response to expansion of inboard or outboard ones of said fluid chambers, each of said pair of elements of said power units having a unidirectional locking means to prevent retrograde outboard movement of the corresponding one of said elements on said support and responsive to pressurization of the corresponding one of said pair of chambers to unlock and permit inboard movement of the corresponding one of said pair of elements.

13. An apparatus as in claim 12 in which each of said supports comprises a shaft and each of said power units is of a generally tubular construction and is telescopically mounted on the corresponding one of said shafts.

14. Apparatus as in claim 13 in which said pair of elements of said power units are coaxially interconnected for reciprocation relative to one another within a positively delimited stroke range.

15. Apparatus as in claim 12 in which said control means comprises a first conduit means defining a common manifold for said inboard fluid chambers of said power units and a second conduit means defining a common manifold for said outboard fluid chambers of said power units.

16. Apparatus as in claim 15 in which both of said conduit means have fluid communication with separate ports of a common control valve.

17. Apparatus as in claim 16 in which said control valve has a relief port means alternately communicable with either said inboard fluid chambers or said outboard fluid chambers.

18. A power unit for driving an article or articles unidirectionally inboard of an elongate support on which the power unit is mounted, comprising:

a pair of elements interconnected to one another for reciprocation relative to one another;

a locking means on each of said elements for unidirectionally locking the corresponding one of said elements against outboard movement relative to the support;

a means for ech of said elements to translate inboard movement thereof into unlocking of the corresponding one of said pair of locking means;

and means to alternately move said pair of elements in the inboard direction.

19. A power unit as in claim 18 in which said pair of elements are coaxially interconnected to one another and have cooperating shape characteristics to positively delimit their stroke range of reciprocation.

20. A power unit as in claim 18 in which said means to alternately move said pair of elements comprises a pair of separate fluid chambers defined by said pair of elements of said power unit.

21. A power unit as in claim 18 in which said pair of elements comprises a barrel assembly and a plunger assembly that are coaxially telescopically engaged with one another and have cooperating shape characteristics to positively delimit their stroke range of reciprocation.

22. A power unit as in claim 18 in which said pair of elements comprises a barrel assembly and a plunger assembly that are coaxially telescopically engaged with one another and in which said means to alternately move said pair of elements in the inboard direction comprises shape characteristics of said barrel assembly and said plunger assembly defining a pair of separate fluid chambers of said power unit.

23. A power unit as in claim 22 in which said shape characteristics also positively delimit the stroke range of said barrel assembly and said plunger assembly.

24. A power unit as in claim 22 in which said barrel assembly is internally formed with an annular piston flange through which a piston rod portion of said plunger assembly coaxially slidably extends, said pair of fluid chambers being defined on axially opposite sides of said annular piston flange.

25. A power unit as in claim 22 in which said barrel assembly is formed with a spaced pair of fluid ports extending radially into said piston flange, one of said ports terminating in an outboard direction into one of said fluid chambers and the other of said ports terminating in an outboad direction into the other of said fluid chambers.

26. A power unit as in claim 18 in which said pair of units are generally tubular in configuration and in which said locking means comprises a lock ring of annular planform.

27. A power unit as in claim 26 in which said locking means comprises a means to bias said lock ring out of coaxial alignment with said pair of elements for unidirectionally locking the corresponding one of said elements against outboard movement relative to the support.

28. A power unit as in claim 18 in which said pair of elements are generally tubular in configuration and in which said locking means comprises a lock ring of annular planform, and in which said means for unlocking said locking means comprises a locking wedge of annular planform, said lock ring and said wedge being coaxially aligned and in mutual abutment.

29. A power unit as in claim 28 in which said wedge has an outboard face of shape characteristics defining a fulcrum about which said lock ring can be pivoted between locked and unlocked positions.

30. A power unit as in claim 29 in which said lock ring is normally biased into a locked position.

31. A power unit as in claim 30 in which said locking means on each of said elements is normally biased into a locked position by means of a spring biased plunger and said pair of elements are keyed together to maintain said spring biased plungers in coaxial alignment.

32. A feed apparatus for an article supply magazine comprising:

an elongate rigid support for mounting on the magazine in an inboard-outboard direction;

a power unit means on said support to drive a row of articles in the magazine in an inboard direction in separate increments of movement of said power unit along said support;

said power unit means comprising a pair of elements interconnected to one another for limited increments of movement relative to one another in an inboard direction;

each of said pair of elements and said support having cooperating means defining a unidirectional locking means to separately prevent retrograde outboard movement of each of said pair of elements, each of said elements, when locked to said support, serving as an abutment against which the other of said elements reacts to move in the inboard direction.

33. An apparatus as in claim 32 in which said pair of elements have cooperating shape characteristics defining a pair of separate variable volume fluid chambers for separately moving said elements in the inboard direction.

34. An apparatus as in claim 32 in which said support comprises a shaft and said power unit is coaxially telescopically mounted on said shaft.

35. An apparatus as in claim 34 in which said shaft and said power unit have key means to normally prevent angular movement of a portion of said power unit relative to said shaft.

36. An apparatus as in claim 35 in which said power unit and key means also have means to translate angular movement of said power unit relative to said shaft into simultaneous unlocking of said pair of unidirectional locking means to permit withdrawal of said power unit along said shaft in an outboard direction.

37. Apparatus as in claim 34 in which said shaft is of generally circular cross-sectional configuration and said pair of elements of said power unit are of generally tubular configuration and are coaxially telescopically slidably mounted on said shaft.

38. An apparatus as in claim 37 in which each of said pair of locking means comprises at least one lock ring of annular planform coaxially mounted about said shaft and normally biased into unidirectional locking engagement with said shaft.

39. An apparatus as in claim 38 in which each of said pair of elements coaxially contains an annular member that is coaxially slidably mounted on said shaft and keyed against angular movement relative to said shaft and having an outboard face in mutual abutment with the corresponding one of said lock rings.

40. An apparatus as in claim 39 in which said outboard face of each of said annular members has shape characteristics defining a fulcrum about which said lock ring can be pivoted between locked and unlocked positions.

41. An apparatus as in claim 39 in which said outboard face of said pair of annular members has shape characteristics adapted to translate angular movement of the corresponding one of said pair of elements relative to said shaft into unlocking movement of the corresponding one of said lock rings.

42. An apparatus as in claim 41 in which said outboard face of each of said pair of annular members has a minor plane surface disposed in a radial plane and a major plane surface set in an oblique plane, the intersection of said two planes defining said fulcrum about which the corresponding one of said lock rings can be pivoted between locked and unlocked positions.

43. An apparatus as in claim 42 in which each of said pair of elements includes a spring means to bias the corresponding one of said lock rings into lock position, said pair of spring means being coaxially aligned on a common axis that is diametrically opposite to the keying engagement location of said pair of annular members and said shaft and that is normally in registration with said oblique surfaces of said annular members.

44. An apparatus as in claim 43 in which said pair of elements are keyed together for relative reciprocation and against relative angular movement, and one of said pair of elements has a handle by means of which both of said pair of elements may be rotated relative to said shaft to effect unlocking of said pair of lock rings.

45. An apparatus as in claim 18 in which said pair of elements comprises a barrel assembly and a plunger assembly that are coaxially telescopically engaged with one another and have cooperating shape characteristics to positively delimit their stroke range of reciprocation.

46. An apparatus as in claim 45 in which said barrel assembly and said plunger assembly have shape characteristics defining a pair of separate fluid chambers to alternately move said pair of elements in the inboard direction in response to alternate fluid pressure therein.

47. An apparatus as in claim 47 in which said barrel assembly is internally formed with an annular piston flange through which a piston rod portion of said plunger assembly coaxially slidably extends, said pair of fluid chambers being defined on axially opposite sides of said annular piston flange.

48. An apparatus as in claim 47 in which said barrel assembly is formed with a spaced pair of fluid ports extending radially into said piston flange, one of said ports terminating in an inboard direction into one of said fluid chambers and the other of said ports terminating in an outboard direction into the other of said fluid chambers.

* * * * *

UNITED STATES PATENT OFFICE

CERTIFICATE OF CORRECTION

PATENT NO. : 4,083,554

DATED : April 11, 1978

INVENTOR(S) : LENARD E. MOEN

It is certified that error appears in the above-identified patent and that said Letters Patent are hereby corrected as shown below:

Column 4, line 40: "fo" should be --of--.

Column 4, line 55: after "schematically" insert --indicated--.

Column 14, line 17: In Claim 47, "as in claim 47" should be --as in claim 46--.

Signed and Sealed this

*Eighth* Day of *August 1978*

[SEAL]

*Attest:*

RUTH C. MASON
*Attesting Officer*

DONALD W. BANNER
*Commissioner of Patents and Trademarks*